US006045214A

United States Patent [19]

Murthy et al.

[11] Patent Number: 6,045,214

[45] Date of Patent: Apr. 4, 2000

[54] INK JET PRINTER NOZZLE PLATE HAVING IMPROVED FLOW FEATURE DESIGN AND METHOD OF MAKING NOZZLE PLATES

[75] Inventors: Ashok Murthy; Steven Robert Komplin; James Harold Powers, all of Lexington, Ky.

[73] Assignee: Lexmark International, Inc., Lexington, Ky.

[21] Appl. No.: 08/827,241

[22] Filed: Mar. 28, 1997

[51] Int. Cl.[7] ..... B41J 3/04; B41J 21/175; B41J 2/05

[52] U.S. Cl. ..... 347/47; 347/65; 347/85

[58] Field of Search ..... 347/47, 63, 65, 347/85

[56] References Cited

U.S. PATENT DOCUMENTS

| | | | |
|---|---|---|---|
| 4,897,674 | 1/1990 | Hirasawa | 347/65 |
| 4,985,710 | 1/1991 | Drake et al. | 347/63 |
| 5,734,399 | 3/1998 | Weber et al. | 347/65 |
| 5,847,737 | 12/1998 | Kaufman et al. | 347/65 X |
| 5,852,460 | 12/1998 | Schaeffer et al. | 347/47 X |

*Primary Examiner*—Fred L. Braun
*Attorney, Agent, or Firm*—Michael T. Sanderson

[57] ABSTRACT

A nozzle plate for an ink jet print head and method therefor is provided. The nozzle plate has a polymeric layer, an adhesive layer attached to the polymeric layer defining a nozzle plate thickness and ablated portions of the polymeric layer and adhesive layer defining flow feature of the nozzle plate which contain ink flow channels, firing chambers, nozzle holes, an ink supply region and one or more projections of polymeric material in the ink supply region of the nozzle plate. The one or more projections are selected from the group consisting of an elongate portion of polymeric material having an ablated portion surrounding the elongate portion, partially ablated spaced elongate fingers having a height which is less than the thickness of the nozzle plate which are parallel to and offset from the ink flow channels, and a plurality of spaced projections having a height which is less than the thickness of the nozzle plate extending from the flow feature surface adjacent the ink flow channels having a spacing between adjacent projections which is sufficient to trap debris before the debris enters the ink flow channels to the firing chambers.

21 Claims, 4 Drawing Sheets

(VIEW 2–2)

(VIEW 3–3)

INK JET PRINTER NOZZLE PLATE HAVING IMPROVED FLOW FEATURE DESIGN AND METHOD OF MAKING NOZZLE PLATES

FIELD OF THE INVENTION

The invention relates to ink jet nozzle plates having improved flow characteristics and to methods for making the nozzle plates for ink jet printers.

BACKGROUND

Print heads for ink jet printers are precisely manufactured so that the components cooperate with an integral ink reservoir to deliver ink to an ink ejection device in the print head to achieve a desired print quality. A major component of the print head of an ink jet printer is the nozzle plate which contains ink supply channels, firing chambers and ports for expelling ink from the print head.

Since the introduction of ink jet printers, nozzle plates have undergone considarable design changes in order to increase the efficiency of ink ejection and to decrease their manufacturing cost. Changes in the nozzle plate design continue to be made in an attempt to accommodate higher speed printing and higher resolution of the printed images.

Although advances in print head design have provided print heads capable of printing with increasingly finer resolution at higher print speeds, the improvements have created new challenges with respect to manufacturing the nozzle plates because of the increase in the complexity of the designs. Accordingly, with more complex flow feature designs, problems that were previously insignificant have become serious detractions in print head reliability and have affected production quality.

For example, when print heads had larger flow channels and nozzle holes, debris in the ink was able to more easily pass through the parts of the ink jet print head, eventually passing out of the print head through the nozzle without creating a problem. Now, however, several of the parts within a print head are much narrower and thus tend to trap debris in the ink flow areas rather than let the debris pass through unimpeded. Trapped debris may result in a nozzle which can no longer receive ink, thus impacting the print quality of the print head.

Filters of various configurations have been used to attempt to catch the debris before it encounters a part within the print head that is too narrow for the debris to pass. Unfortunately, such filters typically either add expensive additional processing steps to the manufacture of the print heads, or produce more resistance to the flow of ink than is necessary to perform the function of filtering, thus creating other problems with the use of the filter.

One filter design is provided in U.S. Pat. No. 5,463,413 to Ho et al. which describes a barrier reef design comprised of pillars formed from the barrier layer attached to the semiconductor substrate. The spacing between the pillars is designed to support a separate nozzle plate and to filter out particles from the ink before the particles reach the barrier inlet channels. In this design, separate nozzle plates and barrier layers are formed which increases production costs and reduces the accuracy and precision required for improved printing.

It is an object of this invention, therefore, to provide improved nozzle plates for ink jet print heads.

It is another object of this invention to provide a method for reducing manufacturing problems associated with the nozzle plate design.

It is a further object of this invention to provide nozzle plates for ink jet printers which possess improved ink filtering characteristics in order to trap debris.

Still another object of the invention is to provide a method for manufacturing nozzle plates for ink jet printers having improved flow characteristics.

SUMMARY OF THE INVENTION

With regard to the above and other objects and advantages, the invention provides a nozzle plate for an ink jet print head having an improved design. The nozzle plate comprises a polymeric layer, an adhesive layer attached to the polymeric layer defining a nozzle plate thickness and ablated portions of the polymeric layer and adhesive layer defining flow features of the nozzle plate which contain ink flow channels, firing chambers, nozzle holes, an ink supply region and one or more projections of polymeric material in the ink supply region of the nozzle plate.

Another aspect of the invention provides a method for making a nozzle plate for an ink jet printer. The method comprises providing a polymeric film made of a polymeric material layer containing an adhesive layer and protective layer over the adhesive layer, laser ablating ink flow channels, firing chambers, nozzle holes and an ink supply region in the film through the protective layer to define flow features of the nozzle plate. Once the flow features are formed, the protective layer is removed from the film and individual nozzle plates are separated from the film so that the nozzle plate can be attached to a semiconductor substrate. At least a portion of the polymeric material in the ink supply region of the nozzle plate remains after ablation to thereby reduce debris produced during the ablation step.

In yet another aspect, the invention provides an ink jet print head for a printer. The print head comprises a semiconductor substrate containing resistance elements for heating ink and a nozzle plate attached to the substrate. The nozzle plate is comprised of a polymeric layer, an adhesive layer attached to the polymeric layer and ablated portions of the polymeric layer and adhesive layer defining flow features of the nozzle plate. The flow features contain ablated regions which provide ink flow channels, firing chambers, nozzle holes and an ink supply region and a substantially unablated region which provides one or more polymeric projections adjacent the ink supply region of the nozzle plate.

An advantage of the invention is a substantial decrease in the amount of ablation required to form the flow features in the polymeric material. As the polymeric material is ablated, decomposition products are formed which adhere to the protective layer of the polymeric film. As the amount of decomposition products attached to the protective layer increases, so does the difficulty of removing the protective layer with water once the flow features are formed in the nozzle plate. However, by reducing the amount of ablation required to form the nozzle plates, removal of the protective layer is substantially improved.

Another advantage of the invention is the substantial improvement in print quality obtained by use of a nozzle plate design which traps or prevents debris from entering the ink supply region of the nozzle plate. The design includes a plurality of projections in the ink supply region which perform a filtering function. Because these projections also require less ablation of the polymeric material, the amount of decomposition products and thus deposits on the protective layer is also reduced. Hence, removal of the protective layer is also enhanced by producing the nozzle plate having projections which provide a filtering function.

BRIEF DESCRIPTION OF THE DRAWINGS

The above and other features and advantages of the invention will now be described in the following detailed description of preferred embodiments in conjunction with the drawings and appended claims wherein:

DETAILED DESCRIPTION OF THE INVENTION

The invention provides improved nozzle plates and improved manufacturing techniques for the nozzle plates for ink jet printers. In particular, the nozzle plates contain polymeric material which projects into the ink supply region of the nozzle plate from the flow feature side thereof. The projections not only contribute to improved manufacturing operations for the nozzle plates, they also improve ink flowability in the flow features of the nozzle plates.

Figure 1:
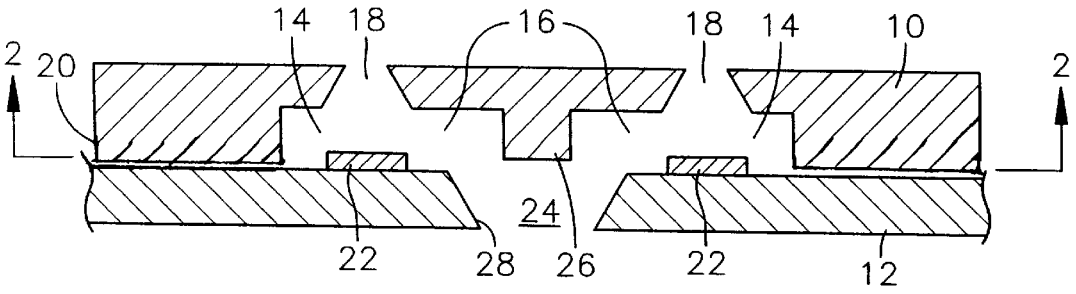
FIG. 1 is a cross-sectional view, not to scale of the nozzle plate of the invention attached to a semiconductor substrate.

Referring now to the figures, there is depicted in FIG. 1 a cross-sectional view of a nozzle plate 10 attached to a semiconductor substrate 12. The nozzle plate is made from a polymeric material selected from the group consisting of polyimide polymers, polyester polymers, fluorocarbon polymers and polycarbonate polymers, preferably polyimide polymers, which have a thickness sufficient to contain firing chambers 14, ink supply channels 16 for feeding the firing chambers 14 and nozzles holes 18 associated with the firing chambers. It is preferred that the polymeric material have a thickness of about 15 to about 200 microns, and most preferably a thickness of about 25 to about 125 microns. For the purpose of simplifying the description, the firing chambers and supply channels are referred to collectively as the "flow features" of the nozzle plates 10 and are ablated into the polymeric material on the flow feature surface 20 of the nozzle plate 10.

Each nozzle plate contains a plurality of firing chambers 14, ink supply channels 16, and nozzle holes 18 which are positioned in the polymeric material so that each nozzle holes is associated with a firing chamber 14 substantially above an ink propulsion device 22 so that upon activation of the device 22 a droplet of ink is expelled from the firing chamber 14 through the nozzle hole 18 to a substrate to be printed. Sequencing one or more firing chambers in rapid succession provides ink dots on the substrate which when combined with one another produce an image. A typical nozzle plate contains a dual set of nozzle holes on a 300 per inch pitch.

Prior to attaching the nozzle plate to the substrate, it is preferred to coat the substrate with a thin layer of photocurable epoxy resin to enhance the adhesion between the nozzle plate and the substrate. The photocurable epoxy resin is spun onto the substrate, photocured in a pattern which defines the supply channels 16 and the firing chambers 14 and the ink supply region 24. The uncured regions of the epoxy resin are then dissolved away using a suitable solvent.

A preferred photocurable epoxy formulation comprises from about 50 to about 75% by weight (-butyrolactone, from about 10 to about 20% by weight polymethyl methacrylate-co-methacrylic acid, from about 10 to about 20% by weight difunctional epoxy resin such as EPON 1001F commercially available from Shell Chemical Company of Houston, Tex., from about 0.5 to about 3.0% by weight multifunctional epoxy resin such as DEN 431 commercially available from Dow Chemical Company of Midland Mich., from about 2 to about 6% by weight photoinitiator such as CYRACURE UVI-6974 commercially available from Union Carbide Corporation of Danbury, Conn. and from about 0.1 to about 1% by weight gamma glycidoxypropyltrimethoxy-silane.

Ink is provided to the firing chambers 14 through an ink supply region 24 which is provided in an opening in the semiconductor substrate 12. A projection or appendage 26 of polymeric material is provided on the flow feature surface 20 of the nozzle plate and extends generally above or into the ink supply region 24 defined by an opening or via 28 in the semiconductor substrate and the ablated region between opposing ink supply channels 16. The polymeric projection 26 may be made by masking the polymeric material so that it is not ablated in the area of polymeric projection 26 or by only partially ablating the polymeric material so that a portion of polymeric material remains in the ink supply region 24.

Figure 2:
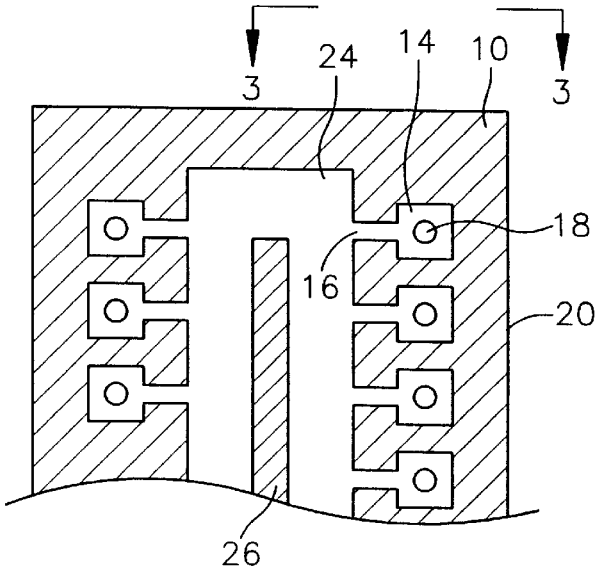
FIG. 2 is a plan view of the nozzle plate of FIG. 1 viewed from the flow feature surface side of the nozzle plate.

FIG. 2 provides a plan view of the nozzle plate of FIG. 1 viewed from the flow feature surface 20 thereof. In FIG. 2 the polymeric projection 26 is shown surrounded by an ablated area which defines the ink supply region 24 for providing ink from ink via 28 to the ink supply channels 16 of each firing chamber 14.

Because the projection 26 lies adjacent the ink supply region 24, there is essentially no constriction of ink from the chip via 28 to the ink supply channels 16 leading to the firing chambers 14 of the nozzle plate. Another advantage of projection 26 is that it provides a reduction in the amount of polymeric material which is ablated thereby substantially reducing the amount of decomposition deposits which form and adhere to a protective or sacrificial layer (not shown) used to assist in removing deposits from the nozzle plates 10 during the laser ablation steps therefor.

Figure 3:
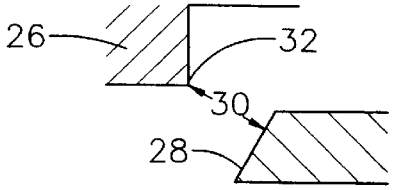
FIG. 3 is a partial cross-sectional view of a portion of a nozzle plate and semiconductor substrate to which it is attached.

The width of projection 26 is not critical to the invention and preferably is not more than about 10 to about 300 microns less than the width of the ink supply region 24 at the point in the ink supply region nearest the projection. It is preferred that the width of the projection 26 be sufficiently narrow to avoid inhibiting the flow of ink to the ink supply channels 16. Accordingly, there is a minimum distance 30 which provides substantially unimpeded ink flow between the edge 32 of projection 26 and chip via 28 as shown in FIG. 3. The minimum distance may range from about 10 to about 300 microns, and is preferably greater than about 20 microns.

Figure 4:
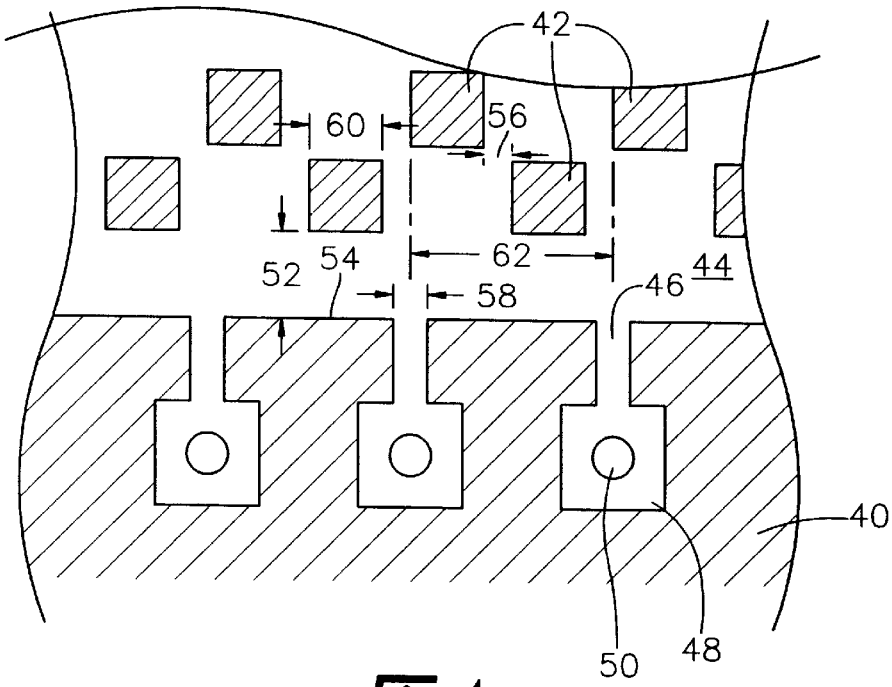
FIG. 4 is another plan view of a nozzle plate of the invention viewed from the flow feature surface side of the nozzle plate.
Figure 5:
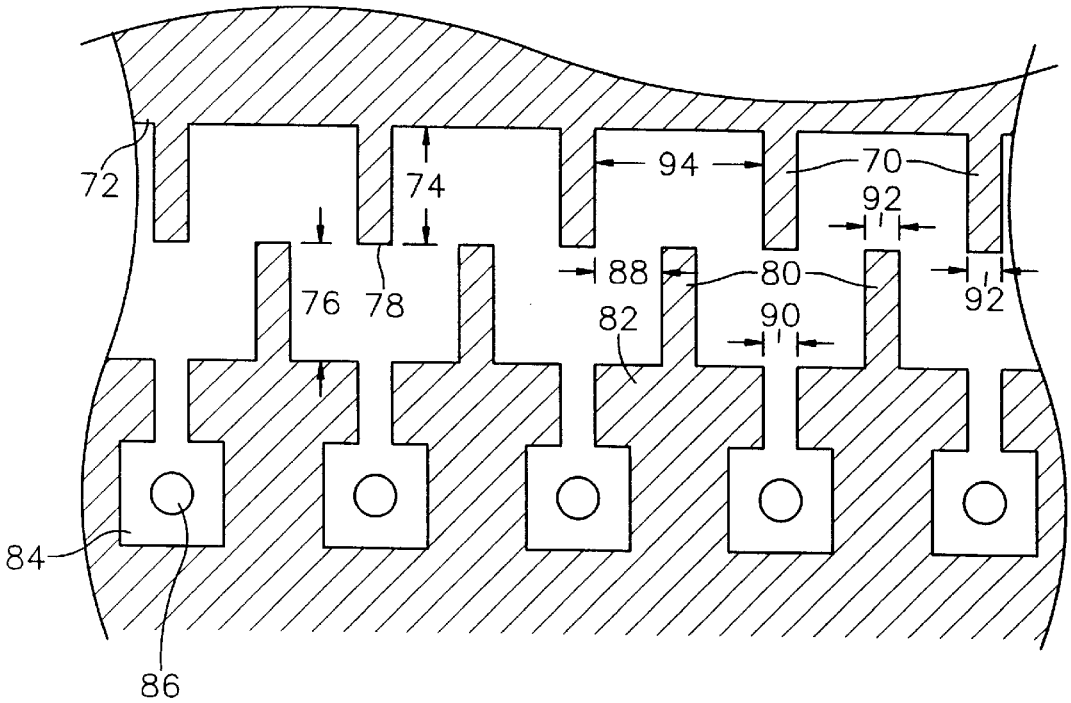
FIG. 5 is yet another plan view of a nozzle plate of the invention viewed from the flow feature surface side of the nozzle plate.

In another aspect, the invention provides projections of different designs generally positioned in the ink supply region of the nozzle plate which provide an additional function of filtering debris from the ink before the ink enters the ink supply channels and firing chambers formed in the polymeric material. FIGS. 4 and 5 illustrate two designs for projections which may be used with the nozzle plate of the invention to filter the ink.

In FIG. 4, the nozzle plate 40, as viewed from the flow feature surface thereof, is made of a polymeric material which has been ablated with a laser to produce projections 42 in the ink supply region 44, ink supply channels 46, firing chambers 48 and nozzle holes 50. In the design illustrated by FIG. 4, the projections have a substantially rectangular shape and are in a substantially staggered array. It is preferred that the projections 42 be at least a distance 52 from the unablated region 54 of the nozzle plate adjacent the ink supply channels 46. The distance 52 preferably ranges from about 5 to about 200 microns.

The distance 56 between projections is related to the width 58 of the ink supply channels. It is preferred that the distance 56 be less than the width 58 and greater than half the width 58. The relationship between distance 56 and width 58 is given by the following equations:

$$2P+2G=C \quad \text{(I)}$$

$$G<T<2G \quad \text{(II)}$$

and $$C=2/R \quad \text{(III)}$$

wherein P is the width 60 of the projections 42, G is the distance 56 between adjacent projections, C is the cell width 62, T is the width 58 of the ink supply channels and R is the print resolution in dots per inch (dpi).

This invention is not limited to any printers having a particular nozzle pitch. Therefore, printers with nozzle pitches of, for example, 100 to 1200 dpi may benefit from the features of this invention.

However, for example, a print head having a resolution R of 600 dots per inch (dpi), with a dual set of nozzle holes on a 300 per inch pitch, will typically have a width 58 ranging from about 6 to about 50 microns. Accordingly, when the width 58 is 26 microns, the distance 56 can range from about 13 to about 26 microns.

In an alternative design, illustrated in FIG. 5, the projections or appendages in the ink supply region may be in the form of spaced, substantially parallel fingers 70 which are formed in the polymeric material and extend laterally from the central region 72 of the nozzle plate which overlies the ink via in the semiconductor substrate (See FIG. 1). The fingers 70 preferably extend a distance 74 from the central region 72 of the nozzle plate so that the distance 76 from the end of the fingers 78 ranges from about 5 to about 200 microns.

It is particularly preferred that fingers 80 which are substantially parallel to fingers 70 and offset in a staggered pattern therefrom also extend from the firing chamber side 82 of the nozzle plate containing the firing chambers 84 and nozzles holes 86. As described with reference to the embodiment shown in FIG. 4, the distance 88 between adjacent fingers 70 and 80 is related to the width 90 of the ink supply channels and the print resolution according to formulas (I), (II) and (III) above. It is preferred that the distance 88 be less than the width 90 and greater than half the width 90.

For example, a print head having a resolution R of 600 dots per inch (dpi), with a dual set of nozzle holes on a 300 per inch pitch, will typically have a width 90 ranging from about 6 to about 50 microns. Accordingly, when the width 90 is 26 microns, the distance 88 can range from about 13 to about 26 microns.

Because a substantial amount of polymeric material remains essentially unablated in the ink supply region of the nozzle plate, there is a significant decrease in the amount of decomposition products which are deposited on the protective layer covering the adhesive layer of the nozzle plate during the ablation process. A reduction in the amount of decomposition deposits on the protective layer has been found to increase the ease and reduce the time required to remove the protective layer. Without being bound by theoretical considerations, it is believed that the decomposition products have a high organic carbon content. The deposits tend to coat the protective layer making it difficult for polar solvents to penetrate the deposits and dissolve the protective layer. Accordingly, by reducing the deposits on the protective layer, removal of the protective layer using a polar solvent is improved.

Figure 6:
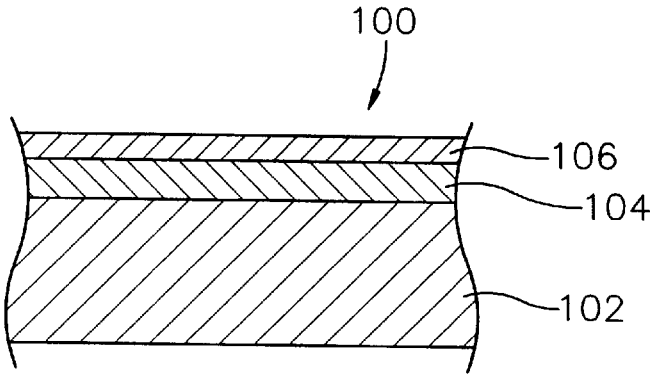
FIG. 6 is a cross-sectional view, not to scale of the polymeric film composite used for making the nozzle plates.

A typical polymeric film 100 used for making the nozzle plates of the invention is shown in cross-sectional view in FIG. 6. The film 100 contains a polymeric material 102 such as a polyimide, an adhesive layer 104 and a protective layer 106 over the adhesive layer 104.

The adhesive layer 104 is preferably any B-stageable material, including some thermoplastics. Examples of B-stageable thermal cure resins include phenolic resins, resorcinol resins, urea resins, epoxy resins, ethyleneurea resins, furane resins, polyurethanes, and silicon resins. Suitable thermoplastic, or hot melt, materials include ethylene-vinyl acetate, ethylene ethylacrylate, polypropylene, polystyrene, polyamides, polyesters and polyurethanes. The adhesive layer 104 is about 1 to about 25 microns in thickness. In the most preferred embodiment, the adhesive layer 104 is a phenolic butyral adhesive such as that used in the laminate RFLEX R1100 or RFLEX R1000, commercially available from Rogers of Chandler, Ariz.

The adhesive layer 104 is coated with a protective layer 106, which is preferably a water soluble polymer such as polyvinyl alcohol. Commercially available polyvinyl alcohol materials which may be used as the protective layer include AIRVOL 165, available from Air Products Inc., EMS1146 from Emulsitone Inc., and various polyvinyl alcohol resins from Aldrich. The protective layer 106 is most preferably at least about 1 micron in thickness, and is preferably coated onto the adhesive layer 104.

Methods such as extrusion, roll coating, brushing, blade coating, spraying, dipping, and other techniques known to the coatings industry may be used to coat the adhesive layer 104 with the sacrificial layer 106. The protective layer 106 could be any polymeric material that is both coatable in thin layers and removable by a solvent that does not interact with the adhesive layer 104 or the polymeric material 102. A preferred solvent for removing the protective layer 106 is water, and polyvinyl alcohol is just one example of a suitable water soluble protective layer 106.

Protective layers which are soluble in organic solvents may also be used, however, they are not preferred. During the removal of the protective layer with an organic solvent, attack of the polymeric material or adhesive may occur depending on the solvent. Accordingly, it is preferred to use protective layers which are soluble in polar solvents such as water.

Figure 7:
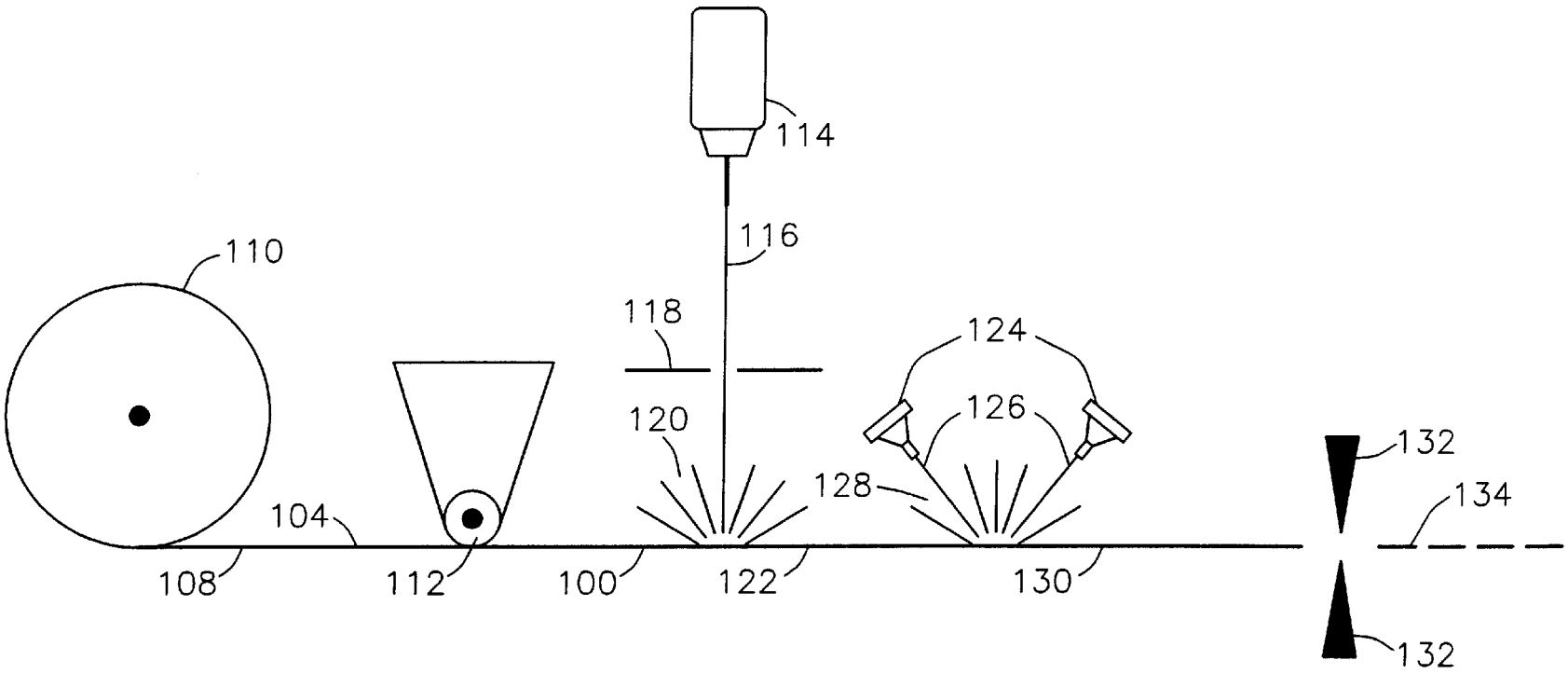
FIG. 7 is a schematic flow diagram of the process for preparing nozzle plates according to the methods of the invention.

A flow diagram illustrating the method for forming nozzle plates in the polymeric film 108 is illustrated in FIG. 7. Initially, the polymeric film 108 containing the adhesive layer 104 on the upper surface thereof is unrolled from a supply reel 110. Prior to ablating the polymeric film 108, the adhesive side of the film 104 is coated with a protective layer 106 (FIG. 6) by roll coater 112. The coated polymeric film 100 is then positioned on a platen so that a laser 114 can be used to ablate the flow features in the polymeric film in order to produce a plurality of nozzle plates in the film.

Figure 8:
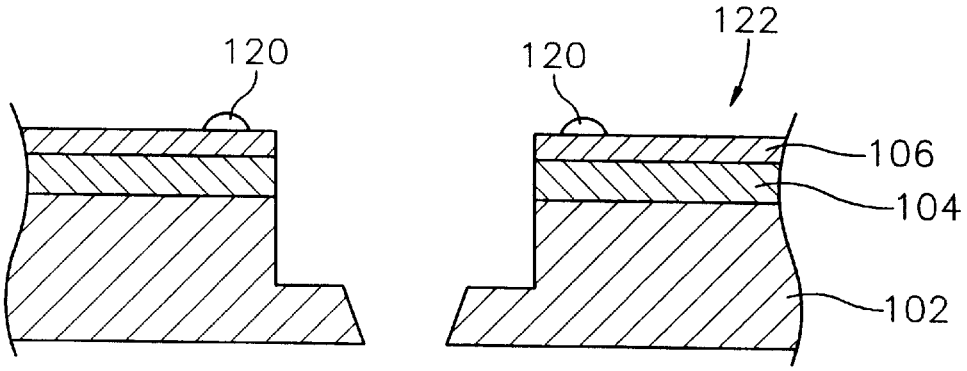
FIG. 8 is a partial view of a cross-section of the polymeric film of FIG. 6 after ablating flow features therein.

The laser beam 116 is directed through a mask 118 and impacts the polymeric film 100 so that portions of the polymeric material are removed from the film in a desired pattern to form the flow features of the nozzle plates. Some of the material removed from the polymeric film 100 forms decomposition products or debris 120 which redeposits on the protective layer 106 of the polymeric film 100 as shown in FIG. 8.

In order to remove the protective layer 106 containing decomposition debris 120 from the film 122, the film 122 is passed through a solvent spray system 124 (FIG. 7) to which directs a solvent spray 126 onto the film 122 to dissolve away the protective layer and thereby also removing the debris attached to the protective layer. The solvent containing the dissolved protective layer material and debris 128 is removed from the film 122 so that the film 130 contains only the polymeric layer 102 and the adhesive layer 104 (FIG. 7).

Subsequent to dissolving and removing the protective layer 106, the nozzle plates are singulated by cutting dies 132 to form individual nozzle plates 134 which are then be attached to a semiconductor substrate. While the process steps have been illustrated as a continuous process, it will be recognized that intermediate storage and other processing steps may be used prior to attaching the formed nozzle plates to the substrate.

Having described the invention and preferred embodiments thereof, it will be recognized that the invention is capable of numerous modifications, rearrangements and substitutions of parts by those of ordinary skill without departing from the spirit and scope of the invention as defined by the appended claims.

We claim:

1. A method for making a nozzle plate for an ink jet printer which comprises providing a polymeric film made of a polymeric material layer containing an adhesive layer and protective layer over the adhesive layer, laser ablating ink flow channels, firing chambers, nozzle holes and an ink supply region in the film through the protective layer and adhesive layer to define flow features of the nozzle plate, removing the protective layer from the film, separating individual nozzle plates from the film and attaching the nozzle plates to a semiconductor substrate wherein at least a portion of the polymeric material in the ink supply region of the nozzle plate remains after ablation to thereby reduce debris produced during the ablation step, the remaining polymeric portion being spaced from an unablated region adjacent the ink flow channels a distance sufficient to trap debris before the debris enters the ink flow channels to the firing chambers, having a height which is less than a combined thickness of the polymeric and adhesive layers and being selected from the group consisting of an elongate portion of polymeric material having an ablated portion surrounding the elongate portion which is substantially perpendicular to the ink flow channels, partially ablated spaced elongate fingers which are parallel to and offset from the ink flow channels, and a staggered array of spaced projections of polymeric material adjacent the ink flow channels.

2. The method of claim 1 wherein the remaining portion of polymeric material comprises an elongate portion of polymeric material having an ablated portion surrounding the elongate portion.

3. The method of claim 1 wherein the remaining portion of polymeric material comprises a first set of spaced elongate fingers which are parallel to and offset from the ink flow channels.

4. The method of claim 3 further comprising ablating a second set of spaced elongate fingers parallel to and extending from the ink flow channels toward the ink supply region which second set is offset from the first set of spaced elongate fingers in the ink supply region thereby providing a staggered array of fingers.

5. The method of claim 1 wherein the remaining portion of polymeric material comprises a staggered array of spaced projections of polymeric material adjacent the ink flow channels.

6. The method of claim 5 wherein the projections are spaced to define gates between adjacent projections for flow of ink therethrough wherein the projections have a width of from about 20 to about 28 microns and the gates have a width of from about 13 to about 26 microns.

7. A nozzle plate for an ink jet print head which comprises a polymeric layer, an adhesive layer attached to the polymeric layer defining a nozzle plate thickness and ablated portions of the polymeric layer and adhesive layer defining flow feature of the nozzle plate which contain ink flow channels, firing chambers, nozzle holes, an ink supply region and one or more projections of polymeric material in the ink supply region of the nozzle plate, the one or more projections being spaced from an unablated region adjacent the ink flow channels a distance sufficient to trap debris before the debris enters the ink flow channels to the firing chambers, having a height which is less than the combined thickness of the polymeric and adhesive layers and being selected from the group consisting of an elongate portion of polymeric material having an ablated portion surrounding the elongate portion which is substantially perpendicular to the ink flow channels, partially ablated spaced elongate fingers which are parallel to and offset from the ink flow channels, and a staggered array of spaced projections extending from the flow feature surface adjacent the ink flow channels.

8. The nozzle plate of claim 7 wherein the one or more projections of polymeric material comprise elongate portions of polymeric material having an ablated portion surrounding the elongate portion.

9. The nozzle plate of claim 7 wherein the one or more projections of polymeric material comprise a first set of spaced elongate fingers which are parallel to and offset from the ink flow channels.

10. The nozzle plate of claim 9 further comprising a second set of spaced elongate fingers parallel to and extending from the ink flow channels toward the ink supply region which second set is offset from the first set of spaced elongate fingers in the ink supply region thereby providing a staggered array of fingers.

11. The nozzle plate of claim 7 wherein the one or more projections of polymeric material comprise a staggered array of spaced projections extending from the flow feature surface adjacent the ink flow channels.

12. The nozzle plate of claim 11 wherein the spacing between adjacent projections define gates and wherein the projections have a width of from about 20 to about 28 microns and the gates have a width of from about 14 to about 22 microns.

13. The nozzle plate of claim 11 having at least two projections adjacent each ink flow channel.

14. An ink jet print head containing the nozzle plate of claim 7.

15. An ink jet print head comprising a semiconductor substrate containing resistance elements for heating ink and a nozzle plate attached to the substrate, the nozzle plate comprising a polymeric layer, an adhesive layer attached to the polymeric layer and ablated portions of the polymeric layer and adhesive layer defining flow features of the nozzle plate wherein the flow features contain ablated regions which provide ink flow channels, firing chambers, nozzle holes and an ink supply region and a substantially unablated region defining one or more polymeric projections adjacent the ink supply region of the nozzle plate, the substantially unablated region being spaced from an unablated region adjacent the ink flow channels a distance sufficient to trap debris before the debris enters the ink flow channels to the firing chambers, having a height which is less than a combined thickness of the polymeric and adhesive layers and being selected from the group consisting of a central elongate portion of polymeric material surrounded by the ablated region which is substantially perpendicular to the ink flow channels, spaced elongate fingers which are parallel to and offset from the ink flow channels, a staggered array of spaced projections extending from the flow feature surface adjacent the ink flow channels.

16. The print head of claim 15 wherein the substantially unablated region comprises a central elongate portion of polymeric material surrounded by the ablated region.

17. The print head of claim 15 wherein the substantially unablated region comprises a first set of spaced elongate fingers which are parallel to and offset from the ink flow channels.

18. The print head of claim 17 further comprising a second set of spaced elongate fingers parallel to and extending from the ink flow channels toward the ink supply region which second set is offset from the first set of spaced elongate fingers in the ink supply region thereby providing a staggered array of fingers.

19. The print head of claim 15 wherein the substantially unablated regions comprise a staggered array of spaced projections extending from the flow feature surface adjacent the ink flow channels.

20. The print head of claim 19 wherein the spacing between adjacent projections define gates and wherein the projections have a width of from about 20 to about 28 microns and the gates have a width of from about 14 to about 22 microns.

21. The print head of claim 19 having at least two projections adjacent each ink flow channel.

* * * * *